United States Patent [19]

Harmsen

[11] Patent Number: 4,780,912

[45] Date of Patent: Nov. 1, 1988

[54] DICKEY

[75] Inventor: Wayne A. Harmsen, Fond du Lac, Wis.

[73] Assignee: Arm-Kor Marketing Corporation, Eden, Wis.

[21] Appl. No.: 80,971

[22] Filed: Aug. 3, 1987

[51] Int. Cl.[4] ..... A41D 23/00

[52] U.S. Cl. ..... 2/91; 2/90; 2/103

[58] Field of Search ..... 2/91, 90, 103, 106, 2/114, 129, 207, DIG. 7

[56] References Cited

U.S. PATENT DOCUMENTS 837,143 11/1906 Starr ..... 2/90

2,809,375 10/1957 Doron ..... 2/91

3,099,013 7/1963 Thorpe ..... 2/103

4,570,268 2/1986 Freeman ..... 2/DIG. 7 X

*Primary Examiner*—Louis K. Rimrodt

*Assistant Examiner*—J. L. Olds

*Attorney, Agent, or Firm*—Donald Cayen

[57] ABSTRACT

A dickey is split along one side corresponding with a person's shoulder and the side of the person's neck. The seams along the split are provided with flexible and adjustable fasteners that adjustably close the seams. The split seams enable the dickey to be put on and taken off without passing it over the wearer's head. The adjustable fasteners enable a dickey to be worn by persons of different sizes.

4 Claims, 2 Drawing Sheets

DICKEY

BACKGROUND OF THE INVENTION

1. Field of the Invention.

This inventions pertains to clothing, and more particularly to clothing for wearing around the neck and shoulders.

2. Description of the Prior Art.

It has long been a problem to protect a person's upper body during cold weather. To solve that problem, various types of clothing have been developed over the years. In addition to the requirement that the garment keep the neck and chest warm, wearers have insisted that such garments be attractive and convenient to put on and remove.

Examples of garments that attempted to meet the foregoing requirements may be seen in U.S. Pat. Nos. 746,586; 837,143; 905,270; 1,016,214; 2,269,491; 3,449,766; and 4,495,660. While the articles of those patents may be satisfactory to some degree, none combines all the features desired in upper body clothing.

For example, some of the garments shown in the foregoing patents are not adjustable, and therefore a particular garment cannot fit persons of different sizes. Some garments are restricted to wearing only in combination with particular other garments, which limits their versatility. Other garments require excessive care in putting on and taking off so as to not mess the wearer's hair. Prior openable garments invariably have the seams extending down the front of the person, which makes the front of the neck and chest vulnerable to drafts and infiltration of cold air.

Thus, a need exists for upper body clothing that combines the features of warmth, comfort, and convenience.

SUMMARY OF THE INVENTION

In accordance with the present invention, a warm and versatile dickey is provided that is attractive and convenient to use. This is accomplished by designing and constructing the dickey with an opening on one side that permits adjusting it to the size of the person wearing it.

The dickey may be made of any suitable material. It may have any shaped collar. The collar is attached to front and back panels that extend over the chest and upper back of the wearer. The upper ends of the front and back panels on one side thereof meet and are joined along a transverse fold line that is designed to drape over one of the wearer's shoulders.

The upper end of the second side of each of the front and back panels is constructed with a seam that also extends through the collar and that is adjustably closeable. As a result, the dickey is openable to a configuration wherein the front and back panels are generally coplanar. The dickey is put on by placing the front and back panels against the chest and back, respectively, of the wearer with the panel fold line resting on one of her shoulders.

To retain the dickey comfortably in place, the opening along the collar and the wearer's second shoulder is adjustably closed and fastened. For that purpose, the dickey includes mating pairs of soft and adjustable fastening elements, which may consist of Velcro brand fasteners. The mating strips are sewn to the dickey in locations such that they are joinable when the dickey is in place. The fasteners neatly close the seams between the collar ends and the two panels, and the fasteners are located so as to be completely hidden from view. By providing adjustment to the dickey of the present invention, a particular garment may be comfortably and fashionably worn by persons of different sizes, thereby decreasing manufacturing and marketing costs. The adjustability feature also permits a person to wear the dickey with different overlying garments without bunching or stretching.

Other advantages and features of the invention will become apparent to those skilled in the art upon reading the detailed disclosure.

DETAILED DESCRIPTION OF THE INVENTION

Although the disclosure hereof is detailed and exact to enable those skilled in the art to practice the invention, the physical embodiment herein disclosed merely exemplifies the invention, which may be embodied in other specific structure. The scope of the invention is defined in the claims appended hereto.

Figure 1:
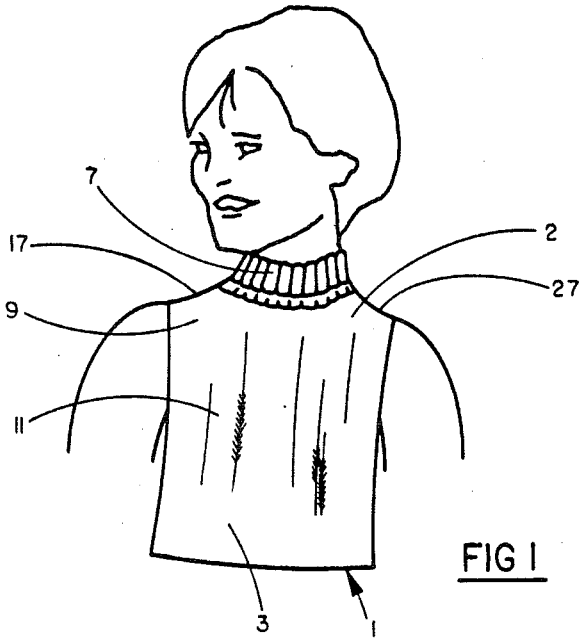
FIG. 1 is a partial perspective view of a person wearing the dickey of the present invention.

Referring to FIG. 1, a warm and comfortable dickey 1 is illustrated that includes the present invention. The dickey is particularly useful for wearing under an outer garment, not shown, such that the upper region 2 is exposed to view.

Figure 2:
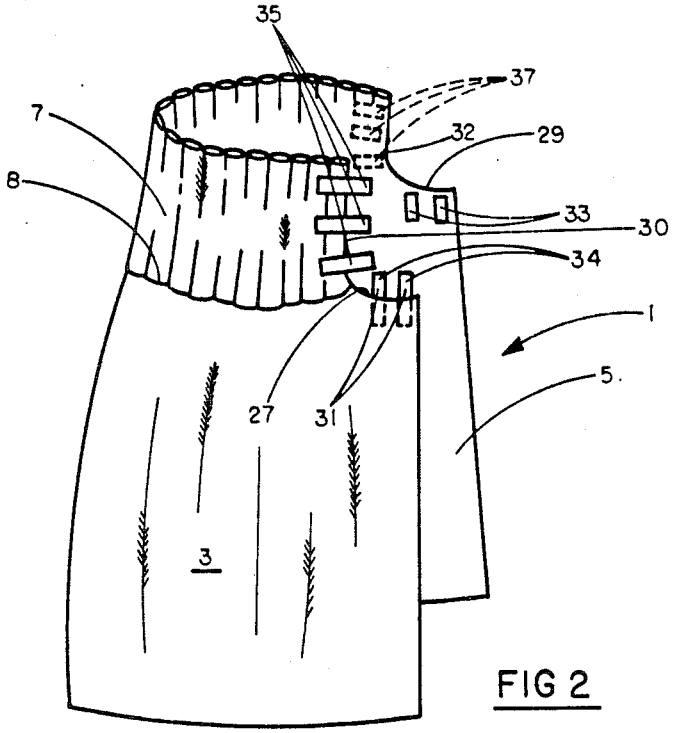
FIG. 2 is an enlarged perspective view of the dickey of the present invention in a condition prior to closing.
Figure 3:
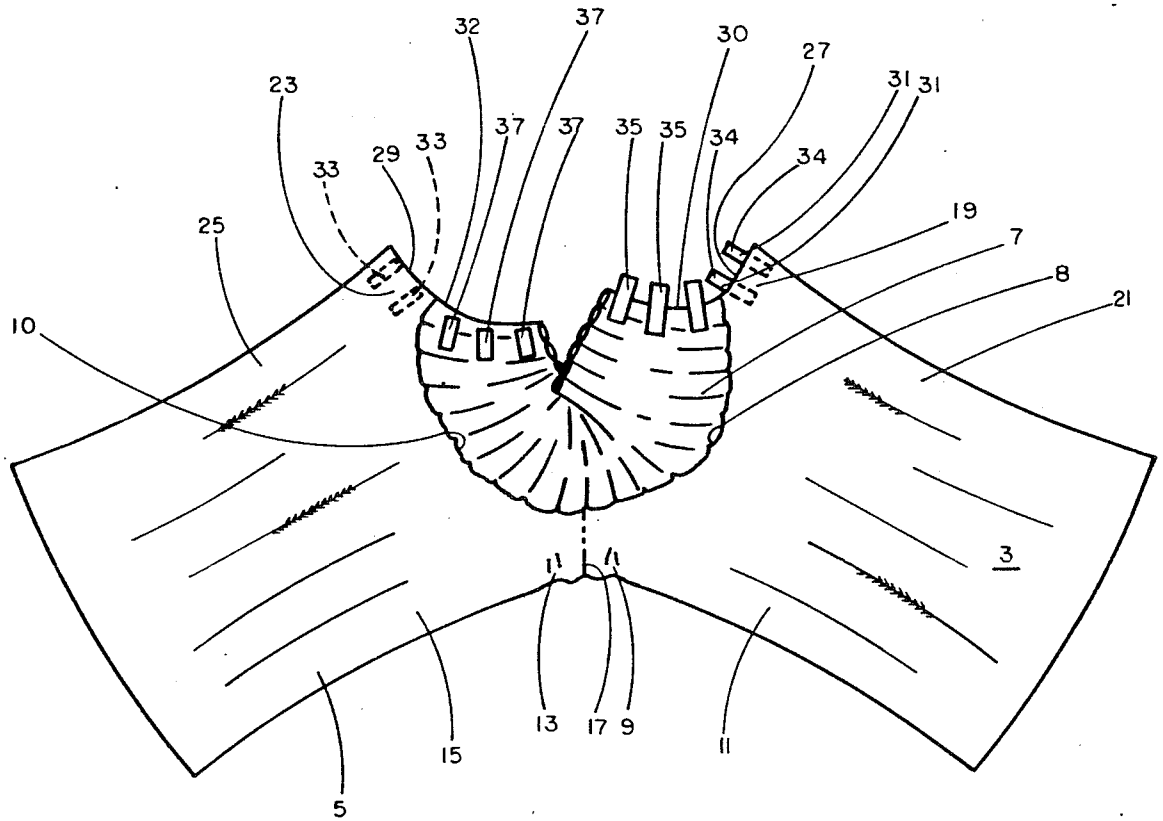
FIG. 3 is a top view of a completely unfolded garment according to the present invention.

Turning also to FIGS. 2 and 3, the dickey 1 comprises a front panel 3, a back panel 5, and a collar 7. The front panel 3 generally covers the upper portion of a person's chest, and the back panel generally covers the person's upper back. The upper end 9 of one side 11 of the front panel and the upper end 13 of one side 15 of the back panel are joined along a common fold line 17. The fold line 17 is designed and constructed to lie on top of one of the wearer's shoulders when the dickey is worn.

The collar 7 is joined to the front and back panels 3 and 5, respectively, along their top edges 8 and 10, respectively. The lines of joining between the panels and the collar span the fold line 17. It will be understood, of course, that the dickey 1 may be made of a single piece of material, such as a knit material, such that the junctions between the panel edges 8 and 10 and the collar do not represent the edges of separate and discrete pieces of material. In FIGS. 1–3, a collar of the turtleneck type is depicted. The collar can be of any desired height. In addition, it will be appreciated that any desired type of collar may be used with the dickey.

To enable the wearer to conveniently put on and take off the dickey 1 without having to pass it over her head, the upper end 19 of the second side 21 of the front panel 3 is not joined directly to the upper end 23 of the second side 25 of the back panel 5. Rather, the upper end 19 of the second side 21 of the front panel terminates in a seam 27. The upper end 23 of the second side 25 of the back panel terminates in a seam 29. Similarly, the collar 7 does not extend continuously in a closed manner. Rather, the collar is discontinuous, and it has a first seam 30 that corresponds with and is a continuation of front panel seam 27. The collar has a second seam 32 that corresponds with and is a continuation of the second panel seam 29.

Secured to the panels 3, 5 adjacent the respective seams 27, 29 are one or more pairs of strips of flexible releasable fasteners 31, 33. The fasteners are preferably of the multiple hook and eye type marketed under the trademark Velcro. As best seen in FIG. 3, the strips 31, 33 are sewn or otherwise secured to the panels on the insides thereof, that is, on the surfaces facing the person when the dickey is worn. The strips 31 are preferably rectangular in shape. They are sewn in place with the major dimension perpendicular to the seam 27 and with the free ends 34 overhanging the seam 27. The free ends 34 of the strips 31 that face the outside of the dickey are designed to releasable connect with the strips 33, such that the seams 27 and 29 can be releasable joined. In a similar manner, one or more pairs of rectangular flexible fasteners 35, 37 are sewn to the collar 7 near the seams 30, 32. The strips 35, 37 are sewn to the outside surface of the turtleneck collar illustrated, and they cooperate to bring together and close the collar seams 30, 32. When the collar is turned down as shown in FIG. 1, the fasteners are hidden from view.

The above described construction of the fasteners 35, 37 for adjustably closing the seams 27, 29, 30, and 32 works very well for turtleneck type collars. However, it will be understood that the dickey of the present invention is not limited to turtleneck collars. Any type of collar may be used with the dickey. If the dickey is fabricated with a collar that is not of a fold down type, the strips 35, 37 are sewn to the collar inside surface. In some fashion designs, the strips 35, 37 may be best sewn with their major dimensions parallel to the corresponding seams.

It is a feature of the present invention that the dickey 1 is extremely easy and convenient to put on and take off. With the seams 27, 29, 30, and 32 separated as shown in FIG. 2, the dickey is slipped on from one side such that the material at the fold line 17 lies on one of the wearer's shoulders. The front panel 3 then covers her chest, and the back panel 5 covers her upper back. The collar 7 is preferably in the turned-up condition. The seams 27 and 29 are then brought together on top of the wearer's second shoulder. The corresponding strips of the Velcro fasteners 31, 33 are brought together and pressed into place. Similarly, the collar seams 30, 32 are brought together adjacent the side of the wearer's neck. The Velcro fasteners 35, 37 are pressed together. Finally, the collar is turned down to the normal wearing configuration. In that manner, the wearer can put on the dickey 1 without passing it over the head, thereby leaving the wearer's hair undisturbed. Removing the dickey is similarly quickly and conveniently accomplished by unfastening the Velcro fasteners and sliding the dickey off the shoulder.

Further in accordance with the present invention, the dickey 1 is exceptionally versatile. It may be worn by runners, hunters, workmen, and other persons who venture out of doors in cold weather. A single size dickey can be conveniently and fashionably worn by persons of different sizes. In that manner, clothing manufacturers need make only a few standard sizes, such as small, medium, large, extra large, and double extra large for men's dickeys, and corresponding standard sizes in women's and children's clothing. The seams 27, 29 and 30, 32 need only be overlapped as required, and the corresponding Velcro strips 31, 33 and 35, 37 are secured to give the proper fit.

With the dickey 1 in place, maximum warmth for the neck, chest, and back is obtained because the dickey seams are located on the side of the person rather than in the front or back. At the same time, the exposed portion of the dickey, including the collar 7 and adjoining fabric 2, creates an attractive article of clothing.

Thus, it is apparent that there has been provided, in accordance with the invention, a dickey that fully satisfies the aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

I claim:

1. An article of clothing comprising:

a. an imperforate and unitary front panel adapted to cover substantially all of a person's chest and having first and second sides, each side including an upper portion, the upper portion of the front panel second side terminating in a first seam;

b. (a) an imperforate and unitary back panel adapted to cover at least a portion of a person's back and having first and second sides, each side including an upper portion, the upper portion of the back panel first side being permanently joined to the upper portion of the front panel first side along a common fold line for draping over a first shoulder of the person, the upper portion of the back panel second side terminating in a second seam;

c. a collar joined to the front and back panels and permanently spanning the fold line between the upper portions of the respective first sides of the front and back panels, the collar terminating only in opposed first and second seams that correspond with and are continuous with the respective first and second seams of the front and back panels; and d. a plurality of pairs of flexible fasteners secured to the front and back panels and to the collar adjacent the respective first and second seams thereof for cooperating to close the panel and collar seams along the neck and second shoulder of the person.

2. The article of claim 1 wherein:

a. the pairs of flexible fasteners are formed as elongated rectangles with the fastener longer dimension perpendicular to the respective seam; and b. at least one fastener of each pair of fasteners overhangs the respective seam to create a fastener free end, so that the second seams of the front and back panels and the collar are adjustably closable by positioning associated fasteners at selected relative locations along their respective longer dimensions.

3. A dickey comprising:

a. an imperforate and unitary front panel adapted to cover at least a portion of a person's chest, the front panel having first and second sides and an upper portion that extends between the person's shoulders, the upper portion adjacent the second side terminating in a first seam;

b. an imperforate and unitary back panel adapted to cover at least a portion of the person's back and having first and second sides and an upper portion that extends between the person's shoulders, the upper portion of the first side being permanently joined to the upper portion of the front panel first side for draping over one shoulder of the person, the upper portion of the back panel adjacent the second side thereof terminating in a second seam;

c. a collar joined to the upper portions of the front and back panels and terminating only in a first seam that is a continuation of the front panel first seam and in a second seam that is a continuation of the back panel second seam;

d. at least one pair of first flexible fasteners secured to the collar adjacent the seams thereof and adapted to close the collar first and second seams along the side of the person's neck; and e. at least one pair of second flexible fasteners secured to the front and back panels adjacent the respective seams thereof to adjustably close the front and back panel seams over the person's other shoulder.

4. The dickey of claim 3 wherein:

a. the first and second flexible fasteners are generally rectangular in shape with the fasteners longer dimension perpendicular to the respective seam; and b. at least one fastener of each pair of first and second fasteners overhangs the respective seam for being selectively positionable relative to the associated fastener along the longer dimension thereof to provide adjustability to the closed locations of the collar and the front and back panel seams.

* * * * *